US005624302A

United States Patent [19]

Hashii et al.

[11] Patent Number: 5,624,302

[45] Date of Patent: Apr. 29, 1997

[54] OSCILLATING SPINDLE SANDER

[75] Inventors: Toshimitsu Hashii, Clemson, S.C.; Robert G. Everts, Chandler, Ariz.

[73] Assignee: Ryobi Motor Products Corp., Easley, S.C.

[21] Appl. No.: 368,031

[22] Filed: Dec. 30, 1994

Related U.S. Application Data

[62] Division of Ser. No. 48,326, Mar. 17, 1993, Pat. No. 5,402,604.

[51] Int. Cl.[6] ..... B24B 47/10

[52] U.S. Cl. ..... 451/157; 451/155

[58] Field of Search ..... 451/155, 157, 451/125, 124, 120

[56] References Cited

U.S. PATENT DOCUMENTS

| | | | |
|---|---|---|---|
| 1,662,137 | 3/1928 | Summers | 451/157 |
| 1,849,868 | 3/1932 | Einstein | 451/157 |
| 2,105,762 | 1/1938 | Zimmerman | 451/157 |
| 2,114,343 | 4/1938 | Gideon | 451/124 |
| 2,242,781 | 5/1941 | Gideon | 451/157 |
| 2,252,176 | 8/1941 | Harris, Jr. | 451/157 |
| 2,323,433 | 7/1943 | Whittaker | 451/157 |
| 2,426,028 | 8/1947 | Krueger | 451/157 |
| 2,484,471 | 10/1949 | Shinn | 74/22 |
| 2,521,900 | 9/1950 | Clark | 74/22 |
| 2,979,962 | 4/1961 | Nindel | 74/22 |
| 3,037,328 | 6/1962 | Kaveny et al. | 451/155 |
| 3,886,789 | 6/1975 | Brookfield | 73/59 |
| 4,397,055 | 8/1983 | Chuchiara | 15/22 R |
| 4,529,044 | 7/1985 | Klueber et al. | 173/48 |
| 5,042,202 | 8/1991 | Klein et al. | 451/124 |

FOREIGN PATENT DOCUMENTS

| | | | |
|---|---|---|---|
| 0220086 | 6/1968 | U.S.S.R. | 451/157 |

OTHER PUBLICATIONS

Wood Magazine, Sep. 1994, Oscillating Spindle Sanders Under $700 We Put Them To The Test, pp. 78–82.

Owners Manual for Clayton Model No. 140, Oscillating Spindle Sander, 1991.

*Primary Examiner*—Robert A. Rose

*Attorney, Agent, or Firm*—Brooks & Kushman P.C.

[57] ABSTRACT

An oscillating spindle sander having a spindle rotatably mounted in a cabinet. An external end of the spindle is adapted to receive a sanding drum. An upper cam pulley is fixedly attached to the spindle and a lower cam pulley is rotatably attached to the spindle within the cabinet. The upper and lower cam pulleys have face-to-face annular cam surfaces having complementary sinusoidal contours with diametrically opposite lobes and diametrically opposite valleys. The upper and lower cam pulleys have a toothed rim connected by individual drive belts to a common drive pulley rotated by an electric motor. The number of teeth on the toothed rims of the upper and lower cam pulleys are different, causing the upper and lower cam pulleys to rotate relative to each other. The annular cam surfaces cause the upper cam pulley and the spindle to be oscillated in a vertical direction in response to the relative rotation between upper and lower cam pulleys.

9 Claims, 5 Drawing Sheets

OSCILLATING SPINDLE SANDER

This is a divisional of application Ser. No. 08/048,326 filed on Mar. 17, 1993 U.S. Pat. No. 5,402,604.

TECHNICAL FIELD

The invention is related to spindle sanders and, in particular, to an oscillating spindle sander having a differential rotating speed cam and follower pulley for oscillating the spindle in a vertical direction.

BACKGROUND ART

Spindle sanders and, in particular, spindle sanders in which the sanding drum is oscillated in a direction normal to the work table are well known in the art. The advantage of oscillating the sanding drum in an axial direction is that the wear on the sanding drum is spread over an extended area and reduces the formation of ridges on the sanded surfaces. Krueger, in U.S. Pat. No. 2,426,028, teaches an oscillating spindle sander having a vertically oriented cam to oscillate the arbor to which the sanding drum is attached. An example of another type of mechanism for oscillating a rotating arbor in an axial direction is taught by Brookfield in U.S. Pat. No. 3,886,789 in which a viscometer is oscillated in an axial direction by a cam follower disposed in a sinusoidal groove. In another example, Cuchiara teaches an annular cam for oscillating a battery powered toothbrush using an annular cam connected to the rotating shaft which engages a mating cam formed on the end enclosure.

SUMMARY OF THE INVENTION

The invention is an oscillating spindle sander having a cabinet with a work table on its upper surface. A vertically oriented spindle is rotatably mounted within the cabinet. The spindle has an external portion which extends above the work table and has means for attaching a sanding drum thereto. An upper cam pulley is fixedly attached to the spindle and is rotatable therewith. The upper cam pulley has a toothed rim having a first number of teeth and an annular cam surface. A lower cam pulley is rotatably attached to the spindle and also has a toothed rim having a second number of teeth and an annular cam surface face-to-face with the annular cam surface of the upper cam pulley. The second number of teeth of the lower cam pulley being different from the first number of teeth of the upper cam pulley. The oscillating spindle sander has an electric motor having a rotary output. A first pulley belt connects the rotary output of the electric motor to the toothed rim of the upper cam pulley and a second pulley belt connects the rotary output of the electric motor to the toothed rim of the lower cam pulley.

A spring member is provided to resiliently bias the cam surface of the upper cam pulley into engagement with the cam surface of the lower cam pulley. Because of the difference in the number of teeth in the toothed rim of the upper cam pulley and the number of teeth in the toothed rim of the lower cam pulley, the upper and lower cam pulleys rotate at different speeds which causes the spindle attached to the upper cam pulley to be oscillated in an axial direction.

In the preferred embodiment, the cam surfaces of the upper and lower cam pulleys have a sinusoidal contour. The sinusoidal contour has a pair of diametrically opposed lobes and a pair of diametrically opposed valleys displaced 90° from the pair of lobes.

One advantage of the oscillating spindle sander is that the cam and cam follower surfaces for producing the axial oscillation of the spindle are structurally rugged, increasing the life of the sander.

Another advantage of the oscillating spindle sander is that the opposing lobes and valleys of the cam surfaces produces balanced vertical forces on the upper cam pulley and the spindle.

Another advantage of the oscillating spindle sander is that the pulley belt moves on both the toothed rim and the drive pulley with the oscillation of the upper cam pulley reducing the wear of the pulley belt.

Yet another advantage is achieved by providing fins on the lower drum washer causing it to act as a centrifugal fan producing an air flow away from the spindle.

These and other advantages will become more apparent from a reading of the specification in conjunction with the drawings.

DETAILED DESCRIPTION OF THE INVENTION

Figure 1:
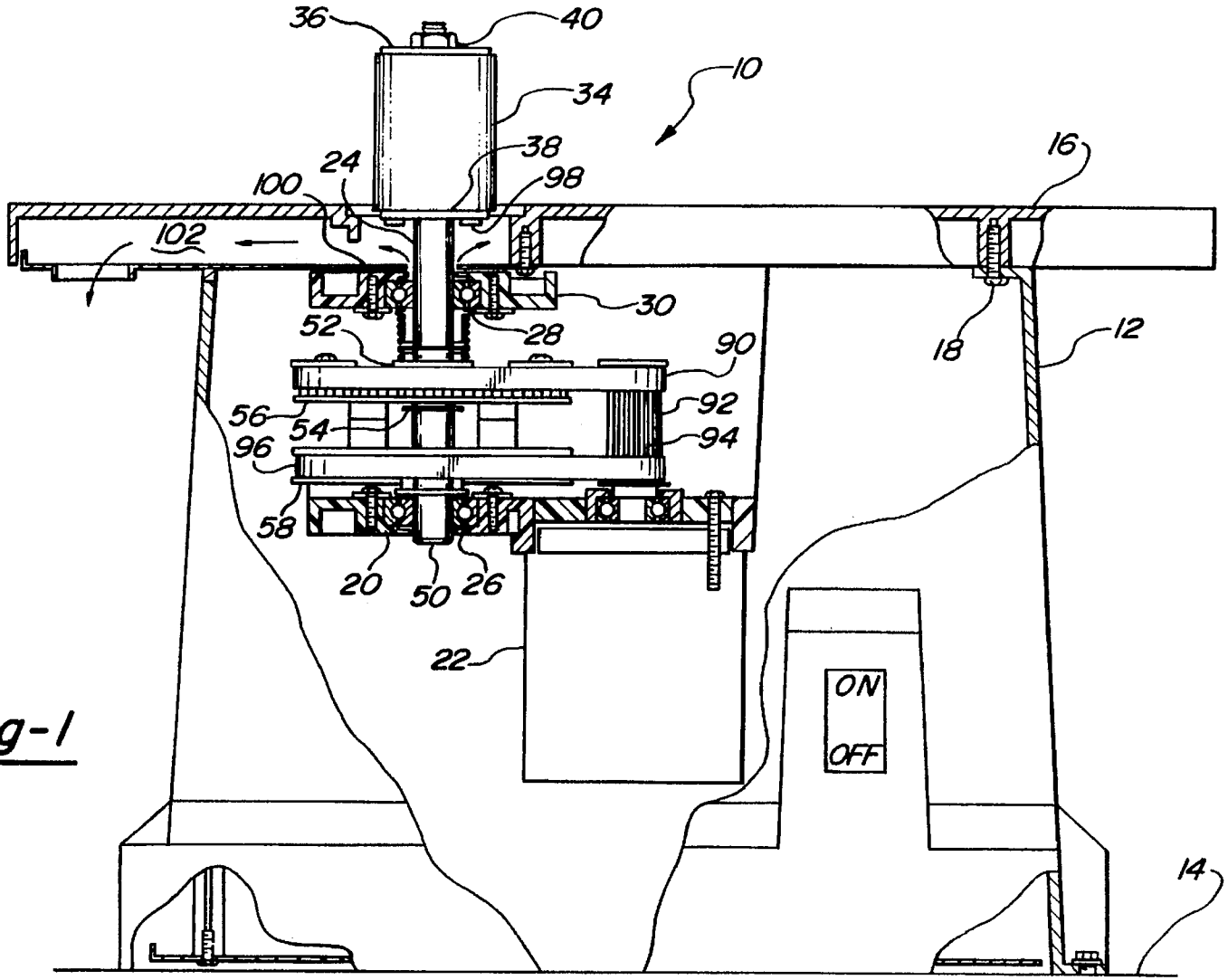
FIG. 1 is a partial cross-section side view of a first embodiment of the oscillating spindle sander.
Figure 2:
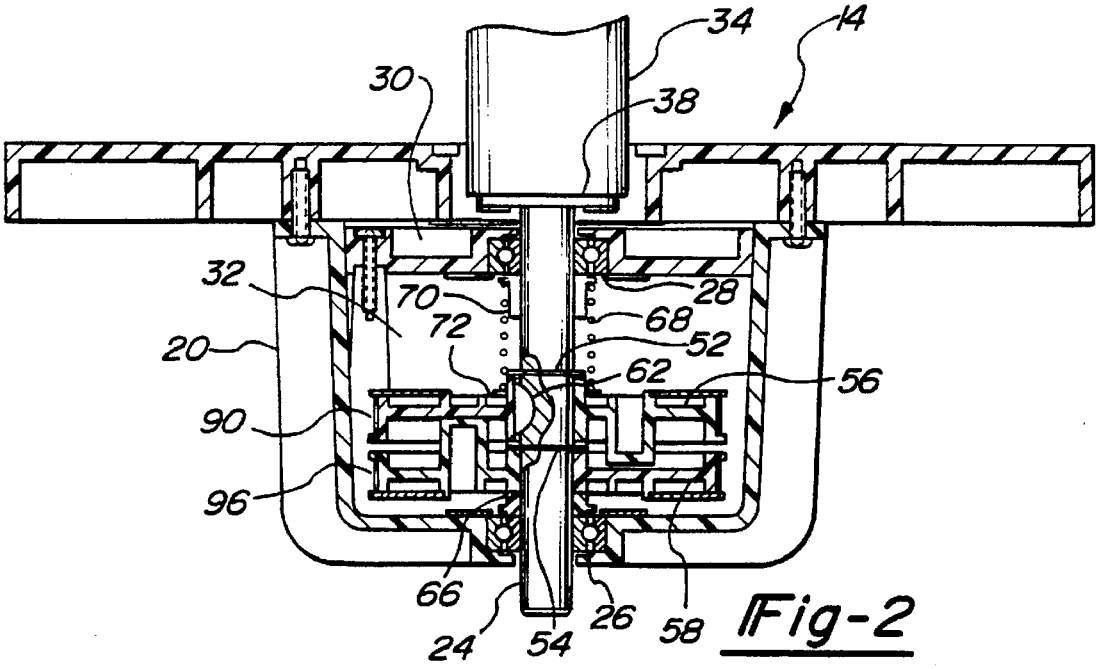
FIG. 2 is a partial cross-sectional end view.

The details of the oscillating spindle sander 10 are shown in FIG. 1. The oscillating spindle sander has an enclosed cabinet 12 mountable to a top surface 14 of a table or bench as is known in the art. A work support platform or work table 16 is attached to the top of the enclosed cabinet 12 using a plurality of fasteners such as screws 18. An internal frame 20 is attached to the underside of the work table 16, as shown in FIG. 2, and supports an electric motor 22 and the lower end of a spindle 24. This internal frame 20 is preferably made from a structural plastic but may be a metal casting or any other type of support structure known in the art. The vertically oriented spindle 24 is rotatably supported by the internal frame 20 at its lower end by a lower bearing 26 and at an intermediate location by an upper bearing 28. The upper bearing 28 is mounted in an upper bearing plate 30 mounted to the inner housing 20 as shown in FIG. 2. The inner housing has a plurality of mounting posts, such as post 32, to which the upper bearing plate 30 is attached.

A sanding drum 34 is attached to the top end of the spindle 24 between a pair of drum washers 36 and 38 by a nut 40.

Figure 3:
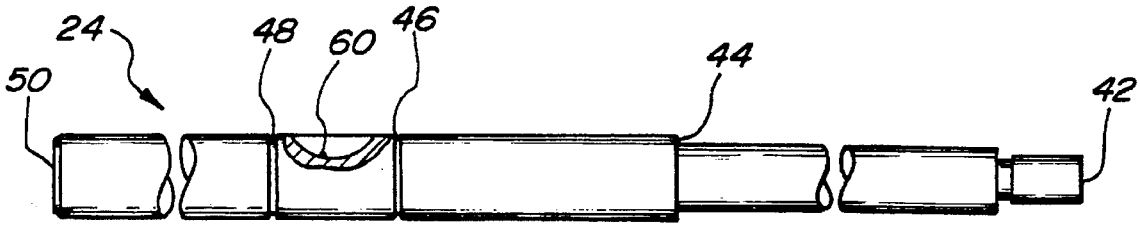
FIG. 3 is a side view of the spindle.

As shown in FIG. 3, the upper end 42 of the spindle 24 is threaded to receive nut 40 and has an annular shoulder 44 which forms a seat for drum washer 38. A pair of annular grooves 46 and 48 are provided in the spindle 24 intermediate the annular shoulder 44 and a lower end 50. These annular grooves receive C-rings 52 and 54, respectively, axially retaining the location of an upper cam pulley 56 to the spindle 24 so that the spindle 24 will be axially displaced with an axial displacement of the upper cam pulley 56 by a lower cam pulley 58 as shall be explained hereinafter.

The spindle 24 also has a key slot 60 provided intermediate the annular grooves 46 and 48 which receives a key 62 as shown in FIG. 2. The key 62 is also received in a key slot 64 provided in the upper cam pulley 56 as shown in FIG. 4 and rotatably connects the spindle 24 to the upper cam pulley 56.

A lower cam pulley spacer 66 is disposed between the lower cam pulley 58 and the inner race of bearing 26 fixedly locating the lower cam pulley 58 relative to the internal frame 20. A coil spring 68 circumscribes the spindle 24 between a spring guide 70 and spring seat 72. The coil spring 68 resiliently biases the spring guide 72 against the inner race of the upper bearing 28 and the spring seat 72 against an upper surface of the upper cam pulley 56. The force produced by the spring 68 resiliently biases a cam surface of the upper cam pulley 56 against a facing cam surface of the lower cam pulley 58, the lower cam pulley against lower cam pulley spacer 66, and the lower cam pulley spacer 66 against the race of lower bearing 26. The coil spring 68 also produces a downward force preventing the sanding drum 34 from being stuck in the "up" position during use.

Figure 4:
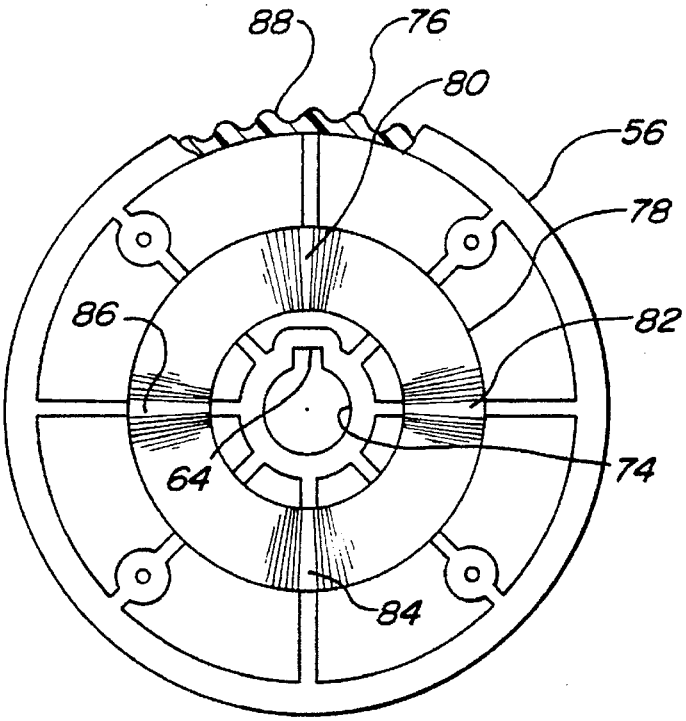
FIG. 4 is a top view of the upper cam pulley.
Figure 5:
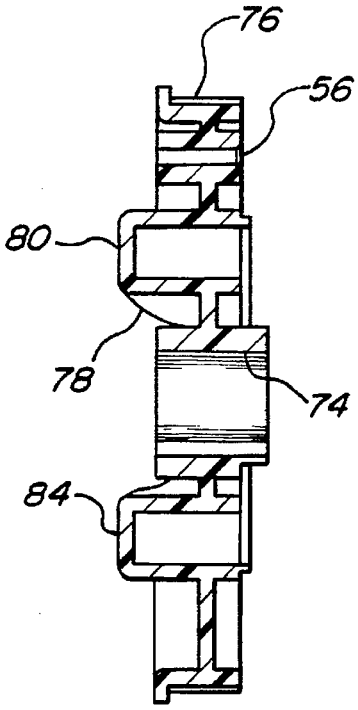
FIG. 5 is a cross-sectional side view of the upper cam pulley.
Figure 6:
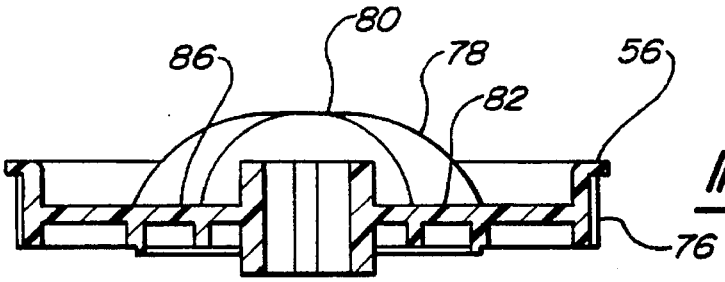
FIG. 6 is a cross-sectional front view of the upper cam pulley.

The details of the upper cam pulley 56 are shown in FIGS. 4, 5 and 6. The upper cam pulley 56 is preferably a structural plastic molding having a mounting bore 74 sized to be slidably received on the spindle 24, a toothed rim 76 and an annular cam surface 78 intermediate the mounting bore 74 and the toothed rim 76. The cam surface 78 has a sinusoidal contour with two diametrically opposed lobes 80 and 84 as shown in FIG. 5 and two diametrically disposed valleys 82 and 86 spaced 90° from the lobes 80 and 84 as shown in FIG. 6. As previously discussed, the upper cam pulley 56 has a key slot 64 in which is received the key 62 which fixedly connects the upper cam pulley to the spindle 24. The toothed rim 76 has a predetermined number of teeth 88 which are engaged by a toothed pulley belt 90 connecting the upper cam pulley 56 to a drive pulley 92 rotatably driven by the electric motor 22. The drive pulley 92 has a set of elongated teeth 94 which extend its axial length.

The structure of the lower cam pulley 58 is substantially the same as the upper cam pulley 56 with the following differences. The lower cam pulley 58 does not have or require a key slot such as key slot 64, the amplitude of the sinusoidal contour of its annular cam surface is different from the amplitude of the sinusoidal contour of the annular cam surface 78 of the upper cam pulley 56 and the number of teeth 88 in its toothed rim 76 are different from the number of teeth 88 in the toothed rim 76 of the upper cam pulley 56. The lower cam pulley 58 is connected to drive pulley 92 by a toothed pulley belt 96. The lower cam pulley 58 is mounted on the spindle 24 with its cam surface 78 face-to-face with the cam surface of the upper cam pulley 56.

Because both the upper and lower cam pulleys are rotated by the common drive pulley 92 and the number of teeth 88 in the toothed rim 76 of the upper cam pulley 56 is different from the number of teeth in the toothed rim of lower cam pulley 58, the upper and lower cam pulleys will rotate at a different speed of rotation as they are simultaneously rotated by the rotation of the drive pulley 92. This difference in the rotational speeds of the upper and lower cam pulleys causes the two cam surfaces to be rotated relative to each other. The relative rotation between the face-to-face sinusoidal cam surfaces causes the upper cam pulley 56 to be axially displaced relative to the lower cam pulley 58. The amplitude of the axial displacement will reach a maximum value when the lobes on the cam surface 78 of the upper cam pulley 56 are aligned on the lobes of the cam surface 78 of the lower cam pulley 58 and will reach a minimum value when the lobes on the cam surfaces 78 of the upper and lower cam pulleys are aligned with the valleys. In a preferred embodiment, the upper cam pulley has 70 teeth while the lower cam pulley has only 69 teeth. Because of the difference in the number of teeth in the upper and lower pulleys, there may be a slight difference in their respective diameters. Therefore, to maintain a proper tension on pulley belts 90 or 96, an idler, not shown, may be used.

As previously indicated, the amplitudes of the annular sinusoidal cam surfaces 78 on the upper and lower cam pulleys 56 and 58, respectively, are different. Preferably, the amplitude of the sinusoidal cam surface 78 on the lower cam pulley is greater than the amplitude of the sinusoidal cam surface of the upper cam pulley to prevent compacting of the sanding dust in the valleys of the cam surface 78 of the lower cam pulley 58. As shown in FIG. 2, in which the left side of the upper and lower cam pulleys are rotated 90° relative to the right side, when the crests of the lobes of the lower cam pulley 58 are engaged with the valleys of the upper cam pulley 56, as shown on the left side, the crests of the lobes of the upper cam pulley are separated from the valleys of the cam surface of the lower cam pulley as shown on the right side. The sanding dust in the valleys of the cam surface of the lower cam pulley therefore is not compacted, and will be expelled from the valleys of the cam surface of the lower cam pulley by centrifugal forces. In the preferred embodiment, the amplitude of the sinusoidal cam surface of the lower cam pulley 58 is between 16 and 20 millimeters (0.7 inches) while the amplitude of the cam surface of the upper cam pulley 56 is between 10 and 18 millimeters (0.625 inches).

The upper and lower cam pulleys are preferably made from plastic materials, such as nylon®, teflon® or KelF® which are structurally rigid and have natural slippery surfaces. Alternatively, the upper and lower cam pulleys may be made from a metal and the cam surfaces coated with teflon® or KelF®.

Figure 13:
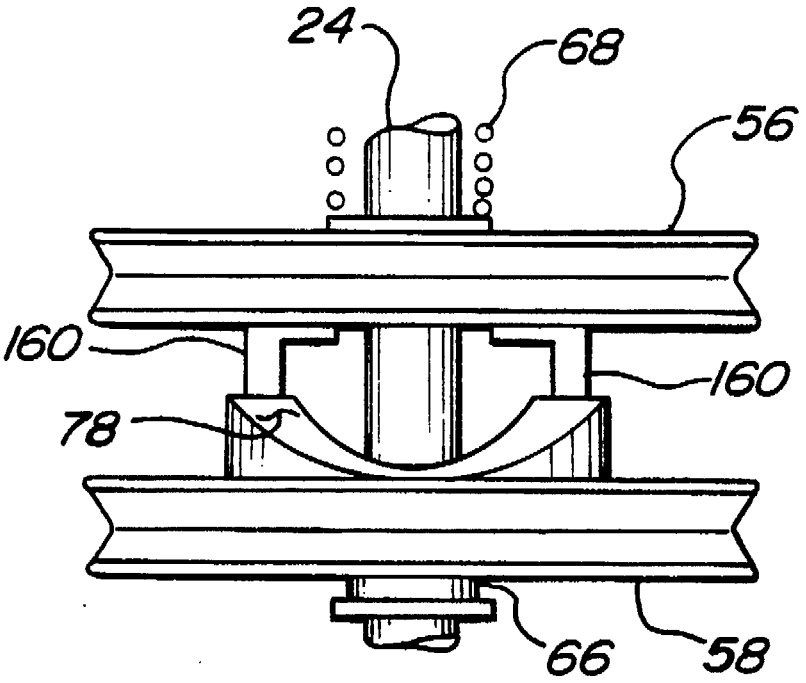
FIG. 13 is a partial side view showing an alternate embodiment having one cam surface engaged by a cam followers.

Technically, only one of the upper and lower cam pulleys 56 and 58, respectively, needs to have a sinusoidal cam surface while the other may, for example, have a pair of diametrically opposed cam followers 160 in the form of radially spaced legs which engage the sinusoidal cam surface of the lower cam surface 78 of the lower pulley 58 as shown in FIG. 13. As in the embodiment shown in FIGS. 1 and 2, the spring 68 maintains the cam followers 160 in contact with the sinusoidal cam surface 78 of the lower cam pulley. Those skilled in the art will recognize that the arrangement of the cam surface and cam followers 160 may be reversed. In the reversed arrangement, the cam followers 160 may be provided on the lower cam pulley 58 and engage the sinusoidal cam surface 78 provided on the upper cam pulley 56.

Figure 7:
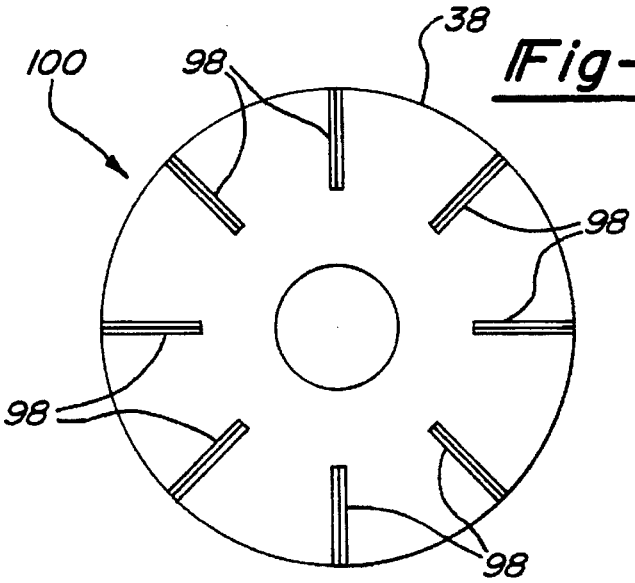
FIG. 7 is a top view of the lower drum washer.
Figure 8:
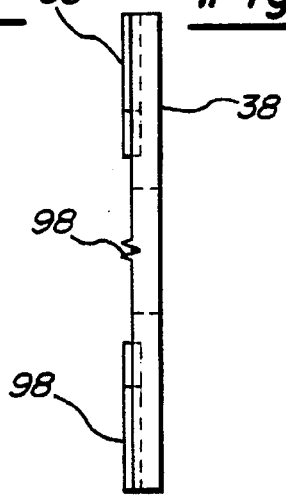
FIG. 8 is a side view of the lower drum washer.

The drum washer 38 supporting the lower end of sanding drum 34 has a plurality of radially extending fins 98, as shown in FIGS. 7 and 8, which cause the washer 38 to function as a centrifugal fan 100 expelling the sanding dust from the region adjacent to spindle 24. This centrifugal fan 100 produces an air flow from inside the enclosed cabinet 12 into a dust exhaust manifold 102 formed in the lower surface of the work table 10 as shown in FIG. 1. A vacuum may also be connected to the dust exhaust manifold for maximum dust extraction efficiency.

The radial fins 98 may be formed by staking, by stamping or any other method known in the art. The formation of the radial fins 98 by staking or stamping preferably produces a non-smooth surface on the drum washer 38 on the side opposite the radial fins which aids in preventing the sanding drum 34 from slipping or rotating relative to the drum washer.

Figure 9:
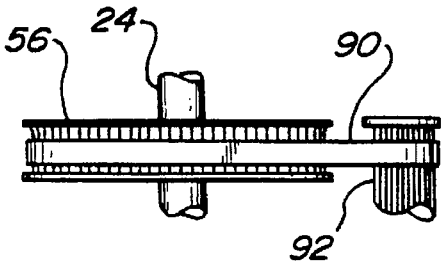
FIG. 9 is a partial side view showing the position of the drive belt when the upper cam pulley is displaced to its uppermost position.
Figure 10:
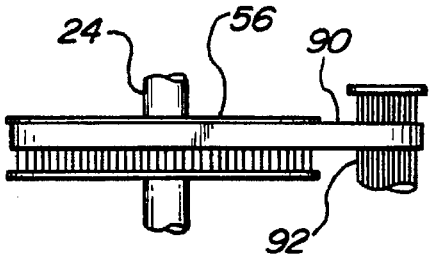
FIG. 10 is a partial side view showing the position of the drive belt when the upper cam pulley displaced to its lowermost position.

In the preferred embodiment, the axial length of the teeth 88 on the upper cam pulley is longer than the width of the pulley belt 90 so that the vertical displacement of the pulley belt 90 is less than the vertical displacement of the upper cam pulley 56 as illustrated in FIGS. 9 and 10. As shown in FIG. 9, when the upper cam pulley 56 is at the apex of its axial displacement, the pulley belt 90 will engage the lower portion of the teeth 88 of the toothed rim 76. However, when the upper cam pulley 56 is at the lower extreme of its axial displacement, as shown in FIG. 10, the pulley belt 90 will be displaced to the upper portion of the toothed rim 76. Thus, the axial displacement of the pulley belt 90 on the drive pulley 92 will be less than the axial displacement or amplitude of the upper cam pulley. This reduction in the axial displacement of the pulley belt along the drive pulley 92 significantly reduces the wear of the pulley belt and extends its life.

Figure 11:
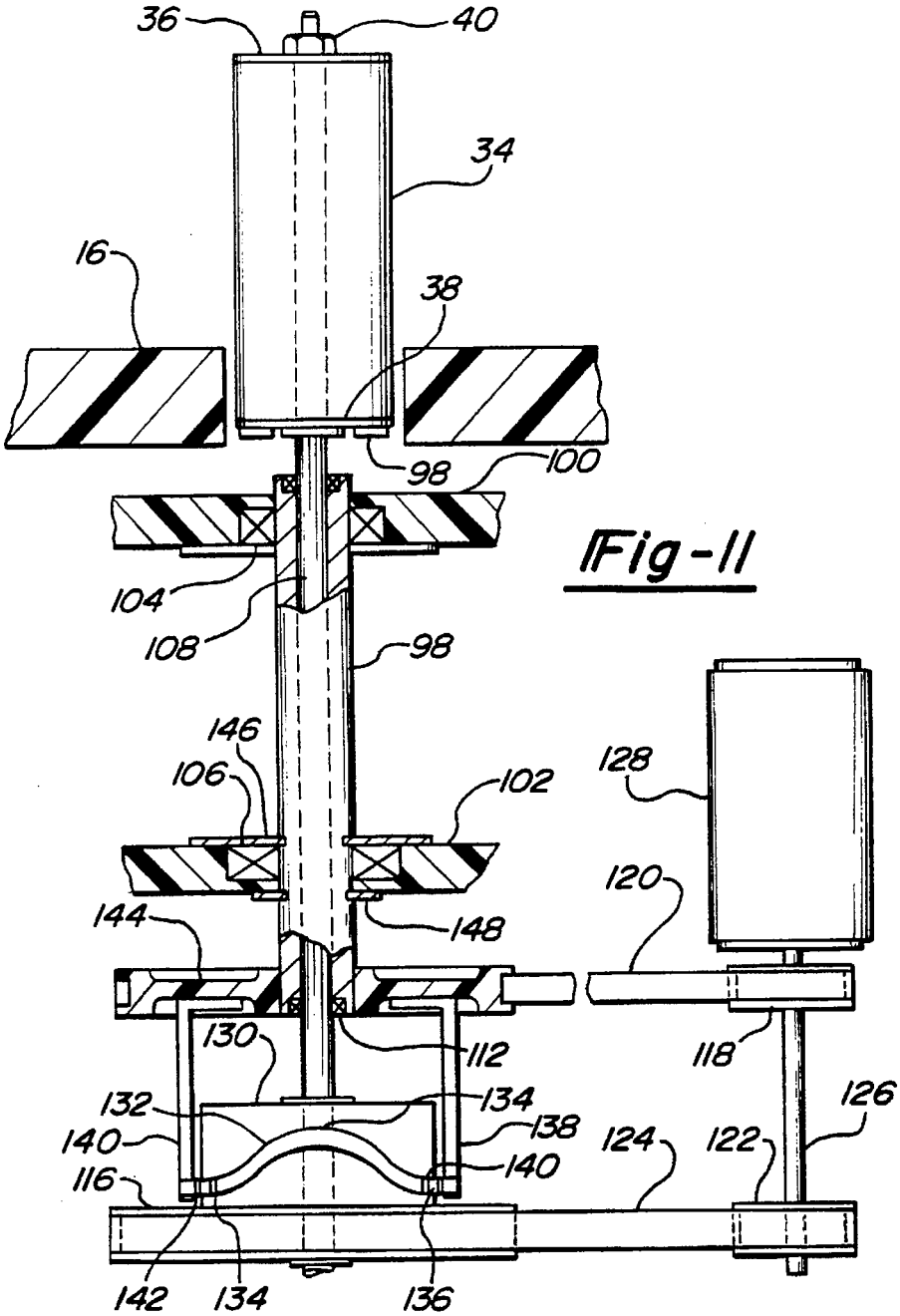
FIG. 11 is a partial cross-sectional side view of an alternate embodiment of the oscillating spindle sander.

An alternate mechanism for oscillating the spindle of an oscillating spindle sander is shown in FIG. 11. In this alternate mechanism, a hollow spindle guide 98 is rotatably mounted to the internal frame members 100 and 102 of the cabinet 10 by bearings 104 and 106, and a spindle 108 rotatably mounted inside the hollow spindle guide 98 by bearings 110 and 112. The bearings 110 and 112 permit the spindle 108 to be displaced axially with respect to the spindle guide 98 as well as to rotate relative thereto. The bearings may be ball bearings, needle bearings, bronze bushings or plastic bushings as is known in the art. A guide pulley 114 is fixedly attached to the spindle guide 98 and rotates therewith and a spindle pulley 116 is fixedly attached to the lower end of the spindle 108.

The guide pulley 114 is connected to a first drive pulley 118 by a pulley belt 120 and the spindle pulley 116 is connected to a second drive pulley 122 by a pulley belt 124. The first and second drive pulleys 118 and 122, respectively, are connected to a rotary output shaft 126 of an electric motor 128.

In the preferred embodiment, the diameters of the guide pulley 114 and the spindle pulley 116 are different and the diameters of the first and second drive pulleys 120 and 124 are substantially the same so that the guide and spindle pulley 114 and 116 rotate at different rates of speed when rotated by the first and second drive pulleys. Alternatively, the guide and spindle pulleys 114 and 116, respectively, may have substantially the same diameter and the first and second drive pulley 120 and 124, respectively, may have different diameters which also would produce a rotation of the guide pulley 14 relative to the spindle pulley 116 when rotated by the first and second drive pulley 116 and 120, respectively.

The spindle pulley 116 has a cylindrical hub 130 on the side facing the guide pulley 114 which has an annular cam groove having a predetermined contour provided therein. In the preferred embodiment, the annular cam groove has a sinusoidal contour having two diametrically opposed peaks 134 and two diametrically opposed valleys 136, but may have more than two diametrically opposed peaks 134 and grooves 136.

At least one cam follower 138 is connected to the guide pulley 114. The cam follower 138 has a finger 140 which is slidably received in the cam groove 132. Preferably, a second cam follower 142 is connected to the guide pulley 114 diametrically opposite cam flowers 138 which also has a finger 144 slidably received in the cam groove 132 at a location diametrically opposite cam follower 138. The second cam follower 140 counterbalances the torque produced on the spindle pulley 116 produced by cam follower 138 and reduces the wear on bearing 112.

A pair of retainer rings 146 and 148, received in grooves provided in the spindle guide 98 on opposite sides of internal frame member 102, inhibit its axial movement. As the guide pulley 114 and the spindle pulley 116 are rotated by the electric motor 128 they will rotate relative to each other. As the result of this relative rotation, the fingers 140 and 144 of cam followers 138 and 142, respectively, following the sinusoidal contour of cam groove 132 producing an oscillatory displacement spindle pulley 116. The oscillatory displacement of the spindle pulley 116 oscillates the spindle 108 and the sanding drum 34 relative to the cabinet's work table 16. As in the embodiment of FIGS. 1–10, the bottom washer 38 supporting the sanding drum 34 may have fins 98 producing an air flow away from the spindle 108.

Figure 12:
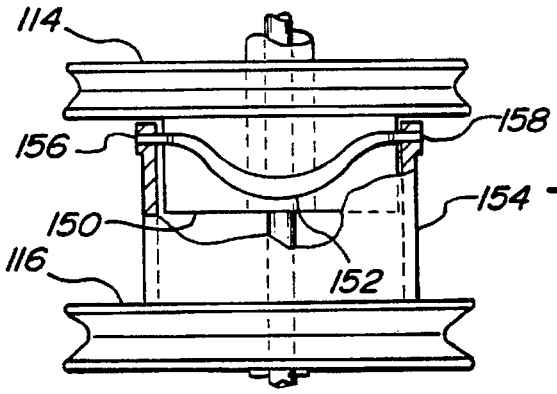
FIG. 12 is a partial cross-section showing an alternate embodiment of the oscillating mechanism.

As shown in FIG. 12, the guide pulley 114' may alternatively have a cylindrical hub 150 which has an annular sinusoidal cam groove 152 corresponding to cam groove 132. In this embodiment, the spindle pulley 116 has a cylindrical extension 154 which circumscribes the hub 150. A pair of cam follower fingers 156 and 158 are attached to the cylindrical extension 154 at diametrically opposed locations and are slidably received in the sinusoidal cam groove 152. As the guide and spindle pulleys 114 and 116 are rotated relative to each other, the cam follower fingers 156 and 158 will follow the contour of the sinusoidal cam groove 152 and will axially oscillate the spindle pulley 116 and the attached spindle 108.

Having described the oscillating spindle sander with respect to a preferred and alternate embodiments as shown in the attached drawings, it is recognized that those skilled in the art may make changes or other improvements within the scope of the invention as set forth in the appended claims.

What is claimed is:

1. An oscillating spindle sander comprising:

a cabinet having a substantially horizontal work table and an internal cavity located below the work table;

a spindle oriented normal to the work table and mounted to the cabinet facilitating free rotation and limited axial oscillation about a central spindle axis, the spindle having an external portion extending from the work table external to the cabinet and an internal portion extending into the internal cavity, the external portion provided with a fastener for mounting a sanding drum thereon;

a single electric motor mounted within the internal cavity and cooperating with the spindle to cause the spindle to rotate;

a cam and follower responsive to the rotation of the spindle to axially drive the spindle upward during an upward portion of the spindle's axial oscillation and to limit the spindle movement during the downward portion of the spindle's axial oscillation, one of the cam and follower being connected to the spindle and axially oscillating therewith, and the other of the cam and follower located at a fixed axial position relative to the work table, the cam having an annular generally sinusoidal face surface extending about the spindle axis for rotatably cooperating with the follower; and a coil spring surrounding the spindle below the work table, resiliently biasing one of said cam and follower in an axial downward direction relative to the work table to maintain the follower and cam in engagement with one another, thereby causing the spindle to axially oscillate relative to the horizontal work table as the spindle rotates.

2. The oscillating spindle sander of claim 1 wherein said spindle cooperates with said follower to oscillate therewith.

3. The oscillating spindle sander of claim 1 wherein said spring coaxially extends about the spindle.

4. The oscillating spindle sander of claim 1 wherein said cam is provided with an annular axially extending face having a generally sinusoidal surface having a pair of diametrically opposed lobes and a pair of diametrically opposed recesses, said follower is provided with a pair of diametrically opposed follower members for engaging the annular cam surface.

5. An oscillating spindle sander comprising:

a cabinet having a substantially horizontal work table;

a spindle oriented normal to said work table rotatably mounted in said cabinet, said spindle having an external portion extending from said work table, said external portion having means for mounting a sanding drum thereon;

a first cam pulley fixedly attached to said spindle, said first cam pulley having a peripheral rim and a cam surface, said rim having a first diameter;

a second cam pulley rotatably attached to said spindle, said second cam pulley having a peripheral rim and a cam surface engaging said cam surface of said first cam pulley, said rim having a second diameter;

a first pulley belt connecting said first cam pulley to a rotary output;

a second belt connecting said second cam pulley to said rotary output;

means surrounding said spindle for resiliently biasing said annular cam surface of said first cam pulley into engagement with said annular cam surface of said second cam pulley; and a single electric motor mounted within said cabinet adjacent to said first cam pulley and said second cam pulley, said motor having said rotary output, said rotary output and said first and second cam pulley rims being sized relative to one another to cause the first and second cam pulleys to rotate at a different speed, causing the first cam pulley and the spindle to axially oscillate in response to the relative rotation of the first and second cam pulleys;

wherein the first cam pulley rim and the first pulley belt have widths which are sized relative to one another in order to minimize belt wear, said first cam pulley rim width being significantly greater that the corresponding width of the first belt to permit limited relative movement.

6. The oscillating spindle sander of claim 5 wherein the motor rotary output has a first region which cooperates with the first pulley belt, said first region having an axial length which is greater than the corresponding width on the first pulley belt to facilitate relative movement therebetween in order to further minimize belt wear.

7. The oscillating spindle sander of claim 5 wherein said cam surface of said first cam pulley forms the annular sinusoidal contour surface and said cam surface of said second cam pulley forms the at least one cam follower.

8. The oscillating spindle sander of claim 5 wherein said cam surface of said second cam pulley forms the annular sinusoidal contour surface and said cam surface of said first cam pulley forms the least one cam follower.

9. The oscillating spindle sander of claim 5 wherein said peripheral rims of the first and second cam pulleys of different diameters and are provided with a toothed surface, and said first belt and second belt and rotary output are each provided with a corresponding toothed surface to inhibit the slippage therebetween.

* * * * *

UNITED STATES PATENT AND TRADEMARK OFFICE

CERTIFICATE OF CORRECTION

PATENT NO. : 5,624,302

DATED : April 29, 1997

INVENTOR(S) : Hashii et al.

It is certified that error appears in the above-indentified patent and that said Letters Patent is hereby corrected as shown below:

Column 8, Line 20, delete the word "that" and insert --than-- in its place.

Signed and Sealed this

Seventh Day of October, 1997

*Attest:*

Bruce Lehman

BRUCE LEHMAN

*Attesting Officer*

*Commissioner of Patents and Trademarks*